US011001955B2

(12) United States Patent
Cho et al.

(10) Patent No.: US 11,001,955 B2
(45) Date of Patent: May 11, 2021

(54) BUBBLE GENERATOR AND WASHING MACHINE HAVING THE SAME

(71) Applicant: Samsung Electronics Co., Ltd., Suwon-si (KR)

(72) Inventors: Hwang-mook Cho, Suwon-si (KR); Geon-ung Lee, Suwon-si (KR); Eun-suk Bang, Hwaseong-si (KR); Dong-pil Seo, Hwaseong-si (KR); Eung-ryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 111 days.

(21) Appl. No.: 16/146,746

(22) Filed: Sep. 28, 2018

(65) Prior Publication Data

US 2019/0100864 A1 Apr. 4, 2019

(30) Foreign Application Priority Data

Sep. 29, 2017 (KR) ..... 10-2017-0127802

(51) Int. Cl.
*D06F 35/00* (2006.01)
*D06F 39/02* (2006.01)
(Continued)

(52) U.S. Cl.
CPC ..... *D06F 35/002* (2013.01); *D06F 33/00* (2013.01); *D06F 39/022* (2013.01); *D06F 39/04* (2013.01);
(Continued)

(58) Field of Classification Search
CPC ..... D06F 35/00; D06F 35/002; D06F 17/02; D06F 17/12; D06F 39/083; D06F 39/088;
(Continued)

(56) References Cited

U.S. PATENT DOCUMENTS 1,948,568 A * 2/1934 Faber ..... D06F 17/12 8/477
5,768,730 A * 6/1998 Matsumoto ..... D06F 33/00 8/159
(Continued)

FOREIGN PATENT DOCUMENTS

EP 1870505 A2 12/2007
JP 2000051107 A * 2/2000
(Continued)

OTHER PUBLICATIONS

JP2000051107—Machine Translation (Year: 2000).*
(Continued)

*Primary Examiner* — Marc Lorenzi

(57) ABSTRACT

A washing machine having a bubble generator includes a bubble spray part provided at an upper side of a tub and configured to discharge bubbles from a top to a bottom inside the tub, a wash liquid jet nozzle provided inside the bubble spray part and configured to jet wash liquid; a blowing fan provided in the bubble spray part and configured to blow air in a direction in which the wash liquid jet nozzle jets the wash liquid; and a porous plate member provided at a front end of the bubble spray part and including a plurality of holes, wherein when the wash liquid jetted from the wash liquid jet nozzle collides with the porous plate member, bubbles are generated.

13 Claims, 12 Drawing Sheets

(51) Int. Cl.

| | |
|---|---|
| ***D06F 39/08*** | (2006.01) |
| ***D06F 39/04*** | (2006.01) |
| ***D06F 33/00*** | (2020.01) |
| *D06F 58/20* | (2006.01) |
| *D06F 25/00* | (2006.01) |

(52) U.S. Cl.
CPC ..... *D06F 39/085* (2013.01); *D06F 25/00* (2013.01); *D06F 39/02* (2013.01); *D06F 58/20* (2013.01); *D06F 2204/04* (2013.01); *D06F 2204/065* (2013.01); *D06F 2204/082* (2013.01); *D06F 2216/00* (2013.01)

(58) Field of Classification Search
CPC ..... A47L 15/10; A47L 2601/03; E03C 1/084; B01F 5/043
See application file for complete search history.

(56) References Cited

U.S. PATENT DOCUMENTS

| | | | | |
|---|---|---|---|---|
| 9,441,321 | B2 | 9/2016 | Yang et al. | |
| 2008/0250823 | A1* | 10/2008 | Oak | D06F 35/002 68/5 C |
| 2011/0277513 | A1* | 11/2011 | Oak | D06F 25/00 68/20 |
| 2014/0059881 | A1* | 3/2014 | Kim | D06F 39/02 34/493 |
| 2015/0176170 | A1* | 6/2015 | Bae | D06F 17/12 68/183 |
| 2016/0326684 | A1* | 11/2016 | Lv | D06F 34/28 |
| 2019/0159651 | A1* | 5/2019 | Choi | A47L 15/0031 |

FOREIGN PATENT DOCUMENTS

| | | | | | |
|---|---|---|---|---|---|
| JP | 2008086868 | A | * | 4/2008 | |
| JP | 2010082351 | A | | 4/2010 | |
| JP | 2014-128344 | A | | 7/2014 | |
| JP | 2016-013222 | A | | 1/2016 | |
| JP | 6135977 | B2 | | 5/2017 | |
| KR | 10-2000-0045029 | A | | 7/2000 | |
| KR | 10-2003-0051271 | A | | 6/2003 | |
| KR | 10-0631576 | B1 | | 9/2006 | |
| KR | 10-2008-0033016 | A | | 4/2008 | |
| KR | 10-2013-0017211 | A | | 2/2013 | |
| KR | 20130041831 | A | * | 4/2013 | E03C 1/084 |
| KR | 10-1618150 | B1 | | 5/2016 | |
| WO | 2014083457 | A1 | | 6/2014 | |

OTHER PUBLICATIONS

JP2008086868—Machine Translation (Year: 2008).*
KR20130041831—Machine Translation (Year: 2013).*
ISA/KR, "International Search Report and Written Opinion of the International Searching Authority," International Application No. PCT/KR2018/011290, dated Jan. 11, 2019, 10 pages.
Supplementary European Search Report in connection with European Application No. 18861435.8 dated May 18, 2020, 8 pages.

* cited by examiner

BUBBLE GENERATOR AND WASHING MACHINE HAVING THE SAME

CROSS-REFERENCE TO RELATED APPLICATION AND CLAIM OF PRIORITY

This application is based on and claims priority under 35 U.S.C. § 119 to Korean Patent Application No. 10-2017-0127802, filed on Sep. 29, 2017, in the Korean Intellectual Property Office, the disclosure of which is incorporated by reference herein in its entirety.

BACKGROUND

1. Field

The present disclosure relates to a washing machine, and more particularly, to a bubble generator capable of generating detergent bubbles and spraying them onto laundry and a washing machine having the same.

2. Description of the Related Art

Generally, a washing machine is an apparatus including a tub containing a predetermined amount of water and a drum rotatably disposed in the tub, and the drum containing laundry is rotated inside the tub to perform washing of the laundry.

Among such washing machines, there is a washing machine provided with a bubble generator configured to generate bubbles by mixing washing water with air for efficient washing.

The conventional bubble generator for generating bubbles includes a circulation pump to circulate washing water in which detergent is dissolved and an ejector to supply air to a flow passage through which the washing water is circulated.

Accordingly, when the washing water is circulated by the circulation pump, the air is sucked into the circulating flow passage by the depressurization in the ejector so that bubbles are generated.

However, since the capacity of the circulation pump is limited, there is a limit to reduced pressure in the ejector. Therefore, the volume ratio of air sucked amount to the volume of circulating washing water is 1 or less.

As described above, the conventional bubble generator has a problem in that the rate of generation of bubbles is slow and the size of bubbles is small because the supply amount of air is small.

In addition, since the conventional bubble generator is disposed in the lower portion of the washing machine, the bubbles generated in the bubble generator flow into the lower portion of the tub and then flow into the drum through the holes of the drum. At this time, the bubbles move from the lower portion of the drum to the upper portion thereof.

As described above, in the washing machine with the conventional bubble generator, the inflow path of the bubbles are long and the resistance is large. Accordingly, there is a problem that the bubbles generated by the conventional bubble generator are small in volume and thus infiltrate into the laundry slowly.

Further, in the conventional washing machine, since the bubbles flow in from the lower portion of the drum, the bubbles are covered by the laundry, so that it is difficult for the user to check whether or not the bubbles are generated.

SUMMARY

The present disclosure has been developed in order to overcome the above drawbacks and other problems associated with the conventional arrangement. An aspect of the present disclosure relates to a bubble generator capable of generating high-expansion bubbles having a volume ratio of 10 or more as compared with a volume of water mixed with detergent and applying the bubbles to laundry instantaneously, and a washing machine having the same.

In addition, another aspect of the present disclosure relates to a washing machine provided with a bubble generator in which a user can easily check whether or not bubbles are generated because the bubbles are supplied from above laundry received in a drum.

According to an aspect of the present disclosure, a washing machine may include a bubble spray part provided at an upper side of a tub and configured to discharge bubbles from a top to a bottom inside the tub; a wash liquid jet nozzle provided inside the bubble spray part and configured to jet wash liquid; a blowing fan provided in the bubble spray part and configured to blow air in a direction in which the wash liquid jet nozzle jets the wash liquid; and a porous plate member provided at a front end of the bubble spray part and including a plurality of holes, wherein when the wash liquid jetted from the wash liquid jet nozzle collides with the porous plate member, bubbles are generated.

The washing machine may include a wash liquid dispersing member provided in front of the wash liquid jet nozzle and configured to disperse the wash liquid jetted from the wash liquid jet nozzle.

A surface of the wash liquid dispersing member facing the wash liquid jet nozzle may be formed in any one of a spherical shape, a conical shape, a flat surface, and a curved surface.

The porous plate member may be formed in a convex shape protruding in a direction in which the wash liquid jet nozzle jets the wash liquid.

The bubble spray part may be formed in a rectangular cross-section, and the wash liquid jet nozzle may be disposed at a center of the rectangular cross-section.

The wash liquid jet nozzle may be connected to a water supply pipe connected to an external water supply source, and the water supply pipe may be provided with a detergent suction part configured to suck detergent.

The wash liquid jet nozzle may be connected to a circulation pipe connected to a circulation pump and configured to circulate water received in the tub, and the circulation pipe may be provided with a detergent suction part configured to suck detergent.

The wash liquid jet nozzle may be connected to a circulation pipe connected to a circulation pump and configured to circulate water received in the tub.

A dry duct provided with a heater may be disposed between the bubble spray part and the blowing fan.

According to another aspect of the present disclosure, a bubble generator for a washing machine may include a bubble spray part formed in a duct having opposite open ends; a wash liquid jet nozzle provided inside the bubble spray part and configured to jet wash liquid a blowing fan provided at a rear end of the bubble spray part and configured to blow air in a direction in which the wash liquid jet nozzle jets the wash liquid; and a porous plate member provided at a front end of the bubble spray part and including a plurality of holes, wherein when the wash liquid jetted from the wash liquid jet nozzle collides with the porous plate member, bubbles are generated.

The bubble generator for a washing machine may include a wash liquid dispersing member provided in front of the wash liquid jet nozzle and configured to disperse the wash liquid jetted from the wash liquid jet nozzle.

Other objects, advantages and salient features of the present disclosure will become apparent from the following detailed description, which, taken in conjunction with the annexed drawings, discloses preferred embodiments.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or, the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

In the following description, a drum washing machine in which laundry is washed by a drop among various types of washing machines will be described as an example.

A washing machine according to an embodiment of the present disclosure will be described in detail with reference to FIGS. 1 and 2.

Figure 1:
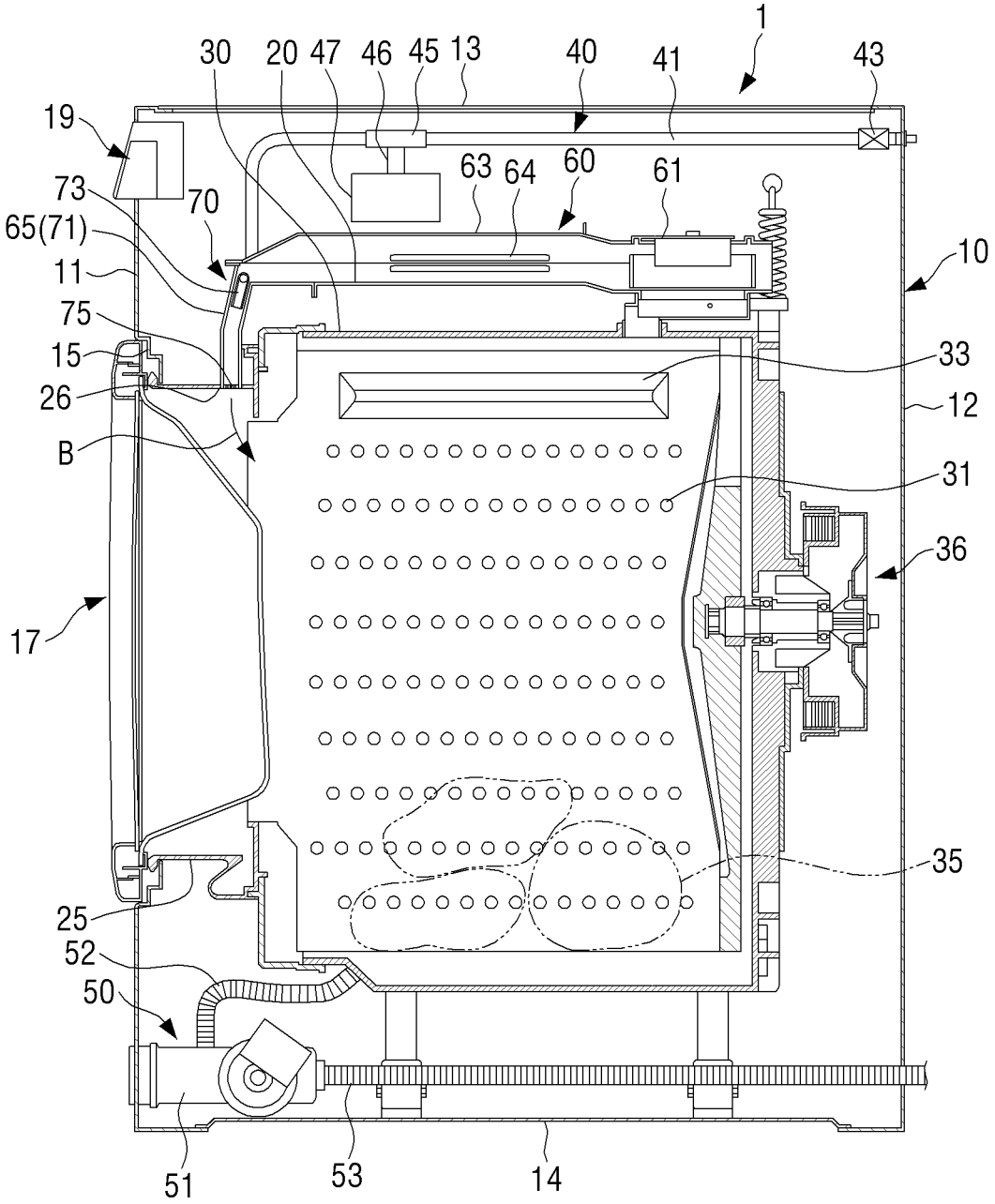
FIG. 1 is a cross-sectional view illustrating a washing machine having a bubble generator according to an embodiment.

FIG. 1 is a cross-sectional view illustrating a washing machine having a bubble generator according to an embodiment. FIG. 2 is a functional block diagram illustrating a washing machine having a bubble generator according to an embodiment.

Figure 2:
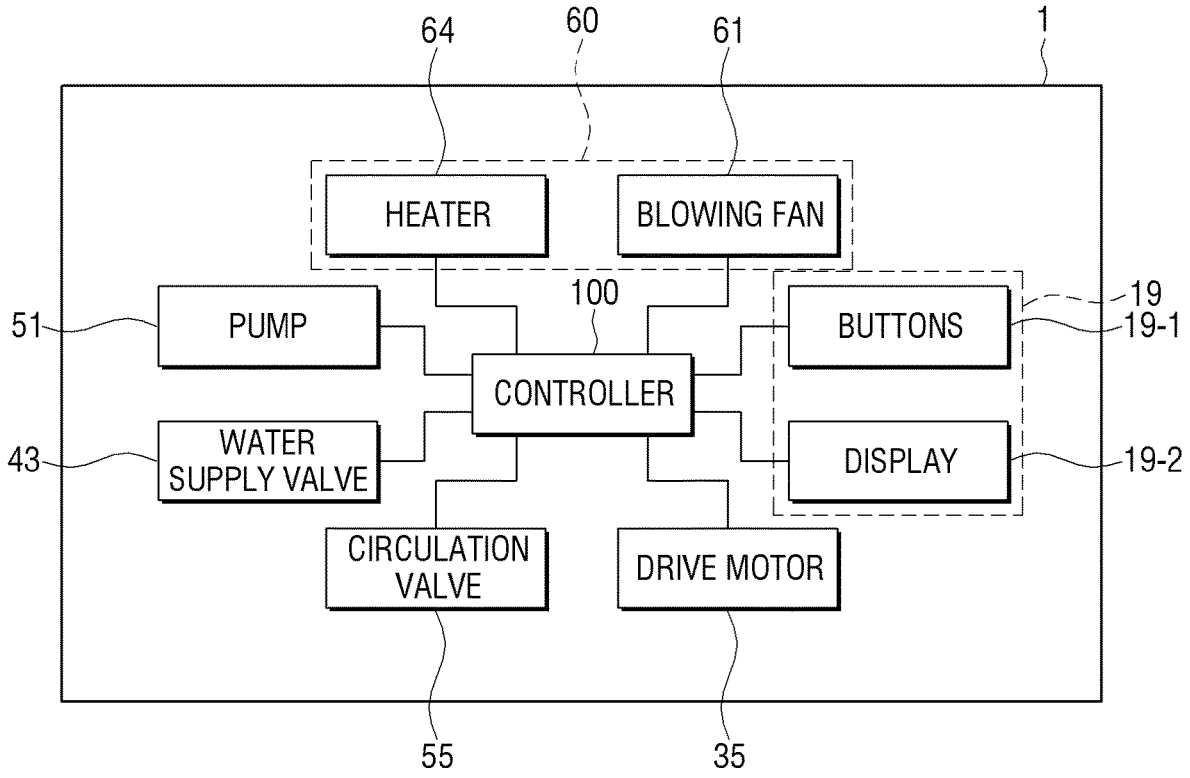
FIG. 2 is a functional block diagram illustrating a washing machine having a bubble generator according to an embodiment.

Referring to FIGS. 1 and 2, a washing machine 1 according to an embodiment of the present disclosure may include a main body 10, a tub 20, a drum 30, a dry apparatus 60, and a bubble generator 70.

The main body 10 forms the appearance of the drum washing machine 1, and has a substantially rectangular parallelepiped shape. The main body 10 may include a front frame 11, a rear frame 12, a left side frame, a right side frame, a top frame 13, and a bottom frame 14.

The front frame 11 of the main body 10 is provided with a laundry inlet 15 through which laundry can be put into and taken out of the main body 10. A door 17 is provided in the laundry inlet 15 to be openable and closable. A control panel 19 configured to control the washing machine 1 may be provided on the upper portion of the front frame 11 of the main body 10.

The control panel 19 may include a plurality of buttons 19-1 configured to input commands for controlling the washing machine 1, a display 19-2 for displaying information related to the washing machine 1 and a washing process, and a controller 100 configured to control the washing machine 1.

The tub 20 is provided inside the main body 10 of the washing machine 1 and is formed in a hollow cylindrical shape having an opening toward the laundry inlet 15 of the front frame 11. The tub 20 may store a predetermined amount of water required for washing. The tub 20 is supported and fixed to the inner surface of the main body 10 by tension springs, oil dampers, and the like.

A diaphragm 25 may be disposed between the tub 20 and the front frame 11 of the main body 10. The diaphragm 25 is formed in a substantially annular shape. One end of the diaphragm 25 is fixed to one end of the tub 20 provided with the opening, and the other end of the diaphragm 25 is fixed to the inner periphery of the laundry inlet 15 of the front frame 11 of the main body 10. The diaphragm 25 prevents water contained in the tub 20 from leaking to the outside of the tub 20 and forms a passage through which the laundry is passed. In addition, the diaphragm 25 blocks vibrations generated when the drum 30 rotates from being transmitted to the front frame 11 of the main body 10 through the tub 20.

The drum 30 is rotatably disposed inside the tub 20 and is formed in a substantially hollow cylindrical shape. An opening corresponding to the laundry inlet 15 of the main body 10 is provided on the front surface of the drum 30. A plurality of through holes 31 through which water can pass are provided in the outer circumferential surface of the drum 30. Further, a plurality of lifts 33 capable of lifting the laundry 35 are provided on the inner surface of the drum 30. The drum 30 may be rotated about a horizontal axis by a driving device including a drive motor 36 disposed on the rear surface thereof.

A water supply device 40 for supplying water to the tub 20 is provided above the tub 20 and a water drainage device 50 for draining water from the tub 20 to the outside is provided below the tub 20.

The water supply device 40 may include a water supply pipe 41 connected to an external water supply source (not illustrated) and a water supply valve 43 for opening and closing the water supply pipe 41. One end of the water supply pipe 41 is connected to the bubble generator 70 described later. The water supply pipe 41 is provided with a detergent suction part 45.

The detergent suction part 45 is formed as a venturi pipe. A detergent pipe 46 connected to a detergent supply part 47 is provided at an intermediate portion of the detergent suction part 45. When the water supply valve 43 is opened and water is supplied to the water supply pipe 41, the detergent in the detergent supply part 47 is mixed with and dissolved in the water by the venturi effect in the detergent suction part 45. Therefore, the water mixed with the detergent is supplied to the bubble generator 70 through the water supply pipe 41. In the following description, the water mixed with detergent is referred to as wash liquid.

The water drainage device 50 may include a pump 51, a first drain pipe 52, and a second drain pipe 53. The pump 51 sucks the water in the tub 20. One end of the first drain pipe 52 is connected to the lower portion of the tub 20, and the other end of the first drain pipe 52 is connected to the pump 51 to guide the water in the tub 20 to the pump 51. One end of the second drain pipe 53 is connected to the pump 51, and the other end of the second drain pipe 53 extends to the outside of the main body 10 so that the water in the tub 20 is discharged to the outside of the washing machine 1. Therefore, when the pump 51 operates, the water in the tub 20 is discharged to the outside of the washing machine 1 through the first drain pipe 52 and the second drain pipe 53.

The dry apparatus 60 for drying the laundry 35 washed by the drum 30 may be provided above the tub 20.

Figure 3:
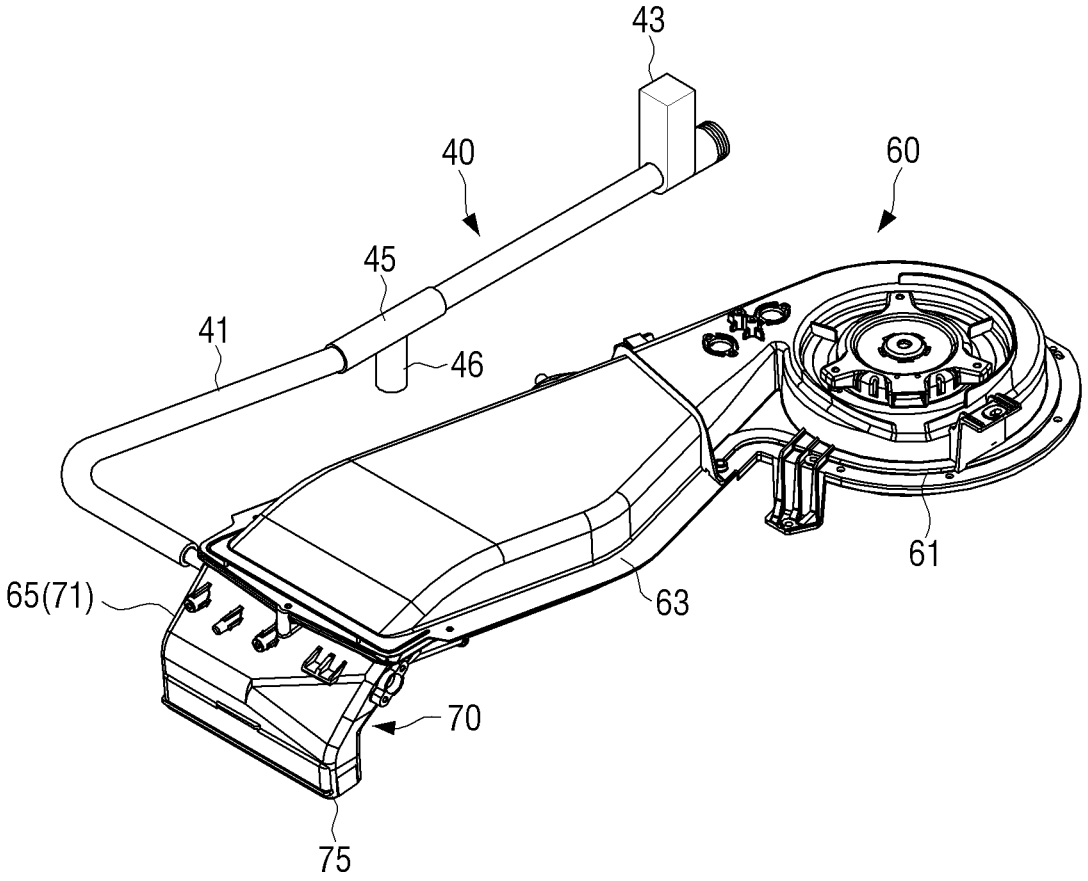
FIG. 3 is a perspective view illustrating a dry apparatus having a bubble generator according to an embodiment.
Figure 4:
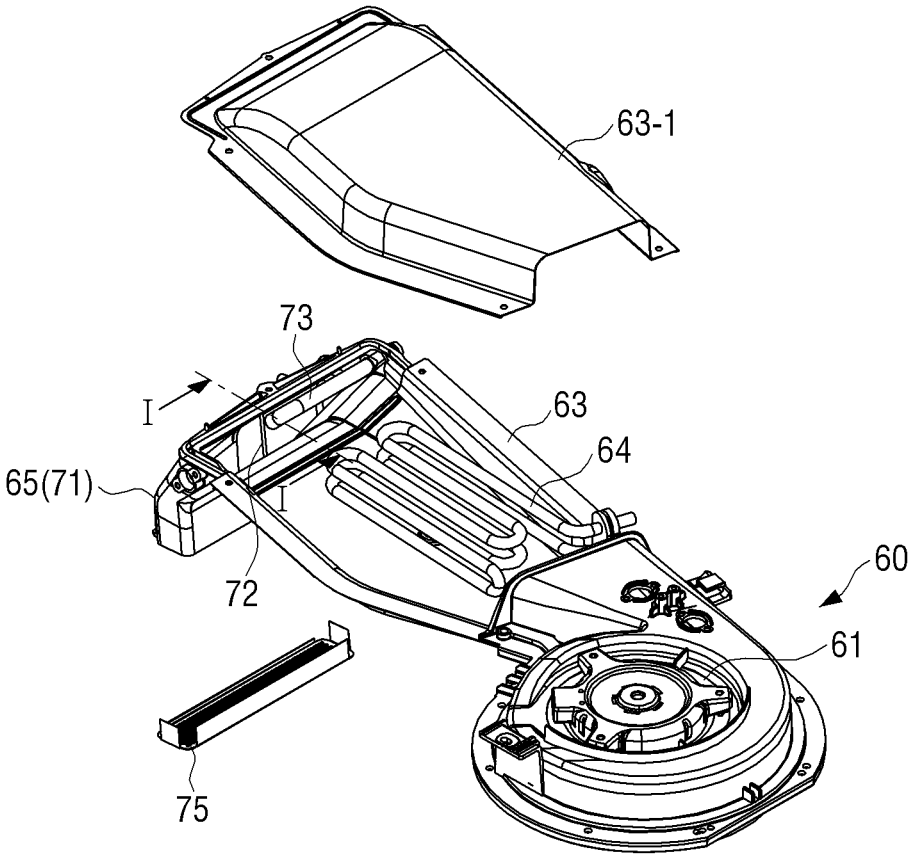
FIG. 4 is a partial exploded perspective view illustrating the dry apparatus having the bubble generator of FIG. 3.

FIG. 3 is a perspective view illustrating a dry apparatus having a bubble generator according to an embodiment of the present disclosure, and FIG. 4 is a partial exploded perspective view illustrating the dry apparatus having the bubble generator of FIG. 3.

Referring to FIGS. 1, 3, and 4, the dry apparatus 60 may include a blowing fan 61, a dry duct 63, and a discharge duct 65.

The blowing fan 61 sucks air from the tub 20 and supplies the air to the dry duct 63. A suction duct (not illustrated) is provided at a suction port side of the blowing fan 61. One end of the suction duct is connected to the suction port of the blowing fan 61, and the other end of the suction duct is connected to the tub 20. Therefore, when the blowing fan 61 rotates, moist air inside the tub 20 is sucked into the blowing fan 61 through the suction duct.

The dry duct 63 is connected to a discharge port of the blowing fan 61. The dry duct 63 removes moisture from the moist air supplied by the blowing fan 61 and discharges the air to the discharge duct 65. To this end, a heater 64 may be disposed inside the dry duct 63. The moist air discharged by the blowing fan 61 is heated while passing through the heater 64 of the dry duct 63 to remove moisture and become hot air. In FIG. 4, reference numeral 63-1 denotes an upper dry duct constituting the dry duct 63.

The discharge duct 65 is connected to one end of the dry duct 63, and connects the dry duct 63 and the diaphragm 25. The diaphragm 25 is provided at an upper portion thereof with an opening 26 to which the discharge port of the discharge duct 65 is connected. The discharge duct 65 may be bent according to the shape and arrangement of the tub 20 and the diaphragm 25 in order to connect the dry duct 63 and the diaphragm 25. In the case of the dry apparatus 60 shown in FIGS. 1, 3, and 4, the discharge duct 65 is formed in a slightly bent shape.

Accordingly, the hot air discharged from the dry duct 63 is discharged into the diaphragm 25 through the discharge duct 65. Since the diaphragm 25 is in fluid communication with the opening of the tub 20, the hot air discharged from the discharge duct 65 is supplied to the inside of the tub 20 and dries the laundry 35.

The suction duct, the blowing fan 61, the dry duct 63, and the discharge duct 65 form a single duct for circulating the air inside the tub 20. Therefore, the moist air inside the tub 20 is heated while circulating through the suction duct, the blowing fan 61, the dry duct 63, and the discharge duct 65 to dry the laundry 35 inside the drum 30.

The discharge duct 65 is provided with a bubble generator 70 configured to generate bubbles of the wash liquid. The bubble generator 70 is disposed on the upper side of the tub 20 and is formed to supply bubbles to the laundry 35 located inside the drum 30. In other words, the bubble generator 70 is disposed to spray bubbles from above the laundry 35 toward the laundry 35.

Figure 5:
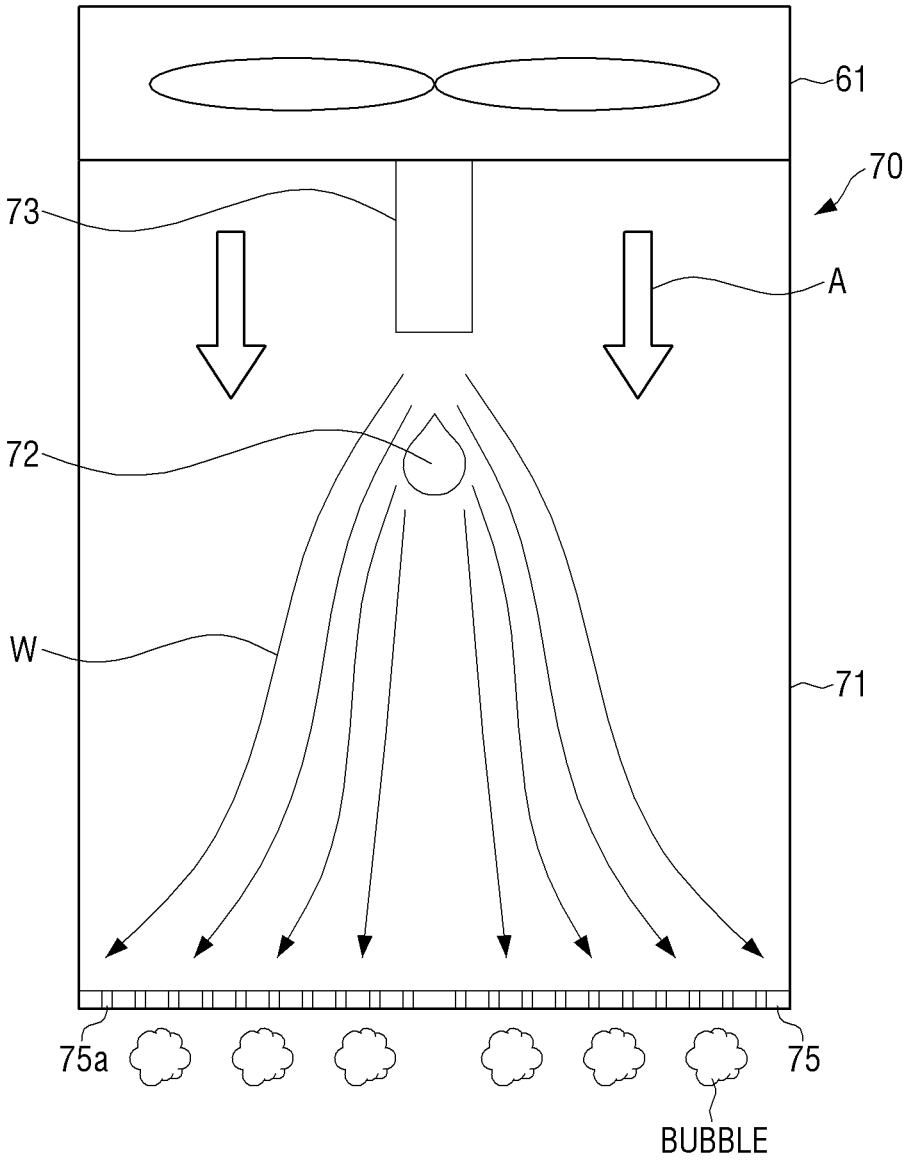
FIG. 5 is a conceptual view illustrating a bubble generator according to an embodiment.
Figure 6:
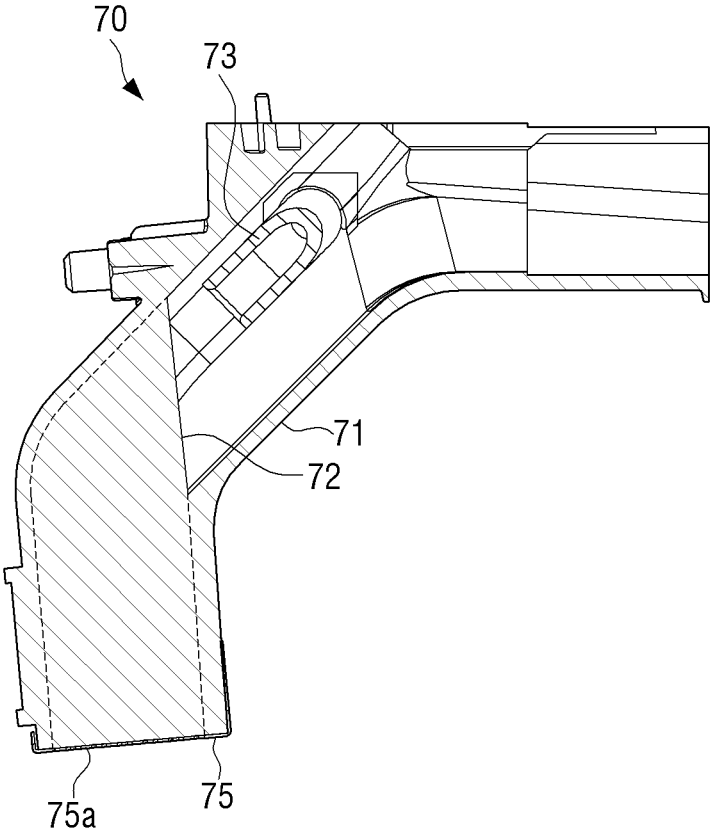
FIG. 6 is a cross-sectional view illustrating the bubble generator of FIG. 4 taken along line I-I.

FIG. 5 is a conceptual view illustrating a bubble generator according to an embodiment of the present disclosure. FIG. 6 is a cross-sectional view illustrating the bubble generator of FIG. 4 taken along line I-I.

Referring to FIGS. 5 and 6, the bubble generator 70 according to an embodiment of the present disclosure may include a bubble spray part 71, a wash liquid jet nozzle 73, a porous plate member 75, and a blowing fan 61.

The bubble spray part 71 is disposed on the upper side of the tub 20 and is formed to supply bubbles from the top of the inside of the tub 20 toward the bottom thereof. In the dry apparatus 60 provided with the bubble generator 70 as illustrated in FIGS. 1, 3, and 4, the discharge duct 65 functions as the bubble spray part 71. In other words, the discharge duct 65 of the above-described dry apparatus 60 is the bubble spray part 71 of the bubble generator 70 according to an embodiment of the present disclosure.

The bubble spray part 71 may be formed in a duct shape having a substantially rectangular cross-section. The wash liquid jet nozzle 73 may be disposed at the center of the rectangular cross-section near the rear end of the bubble spray part 71. However, the cross-section of the bubble spray part 71 is not limited to a rectangular shape. Depending on the type of the wash liquid jetted from the wash liquid jet nozzle 73, the cross-section of the bubble spray part 71 may be formed in a cross-section having a curved circumference such as a circle, an ellipse, or the like, or a polygonal cross-section such as a triangle, a trapezoid, or the like.

Since the discharge port of the discharge duct 65 of the dry apparatus 60 is connected to the opening 26 provided in the upper portion of the diaphragm 25, the bubble spray part 71 of the bubble generator 70 is positioned at the upper portion of the diaphragm 25.

The wash liquid jet nozzle 73 is provided inside the bubble spray part 71 and jets the wash liquid toward the porous plate member 75 provided at the front end of the bubble spray part 71. The wash liquid jet nozzle 73 is connected to a wash liquid supply pipe that can supply the wash liquid.

In the case of the present embodiment, the wash liquid jet nozzle 73 is connected to the water supply pipe 41 connected to the external water supply source. Thus, the water supply pipe 41 serves as the wash liquid supply pipe for supplying the wash liquid to the wash liquid jet nozzle 73. The water supply pipe 41 may be provided with a detergent suction part 45 configured to suck liquid detergent. The detergent suction part 45 is formed as a venturi pipe and is connected to the detergent supply part 47 through the detergent pipe 46. The detergent supply part 47 stores the liquid detergent. Therefore, when the water supply valve 43 provided in the water supply pipe 41 is opened and water flows into the water supply pipe 41, the liquid detergent in the detergent supply part 47 is mixed with the water flowing through the water supply pipe 41 by the venturi effect in the detergent suction part 45, and then the water mixed with the detergent is supplied to the wash liquid jet nozzle 73. Therefore, the wash liquid jet nozzle 73 may jet the wash liquid W mixed with the detergent.

As illustrated in FIG. 5, a wash liquid dispersing member 72 may be provided in front of the wash liquid jet nozzle 73. When the wash liquid W jetted from the wash liquid jet nozzle 73 collides against the wash liquid dispersing member 72, the wash liquid W is dispersed widely. As described above, when the wash liquid jetted from the wash liquid jet nozzle 73 is dispersed widely and collides with the porous plate member 75, the bubble generation efficiency may be increased.

The wash liquid dispersing member 72 may be formed in various shapes as long as the wash liquid W jetted from the wash liquid jet nozzle 73 can be dispersed to an area corresponding to the porous plate member 75. For example, the surface of the wash liquid dispersing member 72 facing the leading end of the wash liquid jet nozzle 73 may be formed in any one of a spherical shape, a conical shape, a flat surface, and a curved surface.

The wash liquid dispersing member 72 shown in FIG. 5 is formed in a water droplet shape, but the shape of the wash liquid dispersing member 72 is not limited thereto. The wash liquid dispersing member 72 provided in the bubble spray part 71 shown in FIGS. 4 and 6 is formed in a flat plate. One end of the flat plate is disposed to face the wash liquid jet nozzle 73. In detail, a center rib of a flat plate shape serving as the wash liquid dispersing member 72 is formed in the center of the bubble spray part 71 in the direction in which the wash liquid is discharged from the bubble spray part 71. The leading end of the wash liquid jet nozzle 73 is provided to face one end of the center rib.

Various examples of the wash liquid dispersing member 72 are illustrated in FIGS. 7A to 7G.

FIGS. 7A to 7G are views illustrating various examples of a wash liquid dispersing member of a bubble generator according to an embodiment of the present disclosure.

Figure 7A:
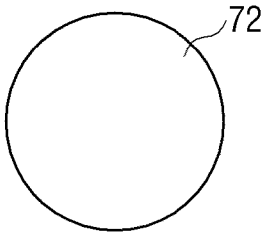
FIGS. 7A to 7G are views illustrating various examples of a wash liquid dispersing member of a bubble generator according to an embodiment.
Figure 7B:
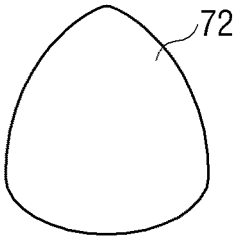
Figure 7C:
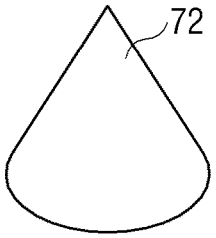

The wash liquid dispersing member 72 may be formed in a spherical shape (FIG. 7A), a warhead shape (FIG. 7B), or a conical shape (FIG. 7C). Alternatively, the wash liquid dispersing member 72 may be formed in a rectangular parallelepiped, a semicircular column, or a triangular column as shown in FIGS. 7D, 7E, and 7F.

Figure 7D:
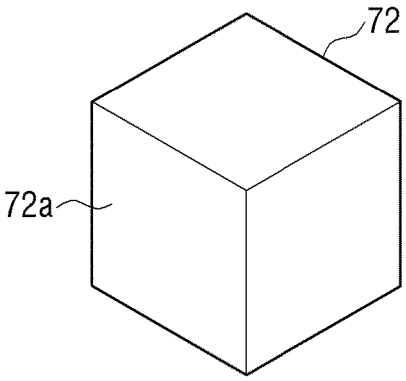
Figure 7E:
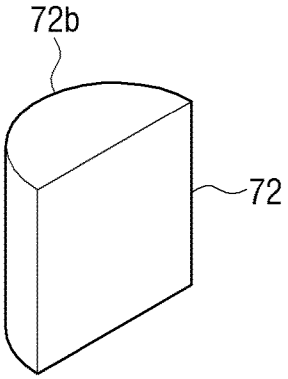
Figure 7F:
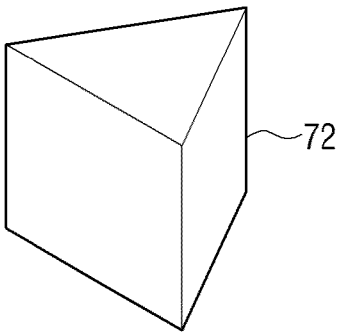

At this time, when the wash liquid dispersing member 72 is a rectangular parallelepiped as illustrated in FIG. 7D, the leading end of the wash liquid jet nozzle 73 may be provided to face one surface 72*a* of the rectangular parallelepiped. When the wash liquid dispersing member 72 is a semicircular column as illustrated in FIG. 7E, the leading end of the wash liquid jet nozzle 73 may be provided to face a rounded surface 72*b* of the semicircular column which is a curved surface.

Figure 7G:
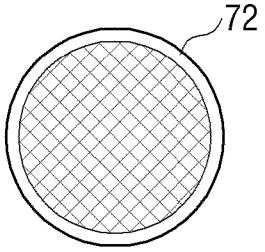

As another example, the wash liquid dispersing member 72 may be formed of a porous plate as illustrated in FIG. 7G. FIG. 7G shows a case where the porous plate is formed of a screen mesh. However, the porous plate may be formed by drilling a plurality of holes in a flat plate.

The wash liquid W jetted from the wash liquid jet nozzle 73 and dispersed by the wash liquid dispersing member 72 collides against the porous plate member 75 to form bubbles.

The porous plate member 75 is provided at the front end of the bubble spray part 71 and is formed in a flat plate having a plurality of holes 75*a*. The porous plate member 75 may be formed of a perforated mesh or a screen mesh. Here, the perforated mesh refers to a flat plate having a plurality of holes 75*a*.

The wash liquid W jetted from the wash liquid jet nozzle 73 collides with the porous plate member 75, and is discharged to the outside of the bubble spray part 71 through the plurality of holes 75*a* formed in the porous plate member 75, thereby generating bubbles.

The porous plate member 75 provided in the bubble generator 70 according to an embodiment of the present disclosure as illustrated in FIGS. 4 and 5 is formed in a flat plate. However, the shape of the porous plate member 75 is not limited thereto. The porous plate member 75 may be formed in various three-dimensional shapes as long as the wash liquid W can collide with the porous plate member 75 to form bubbles.

Figure 8A:
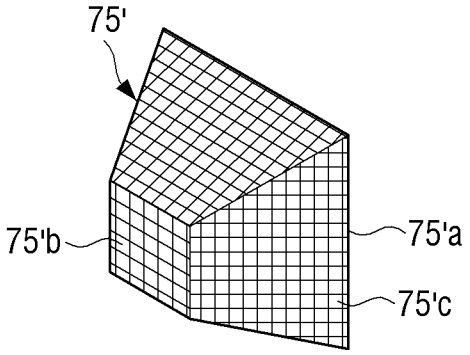
FIGS. 8A and 8B are perspective views illustrating examples of a porous plate member of a bubble generator according to an embodiment.
Figure 8B:
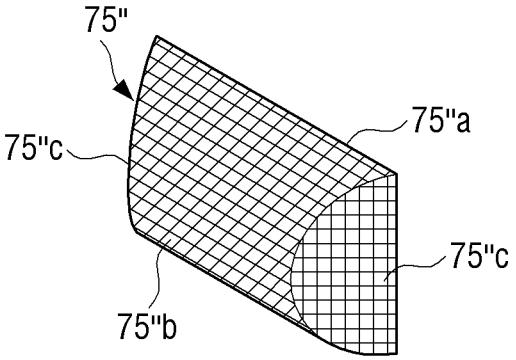

For example, as illustrated in FIGS. 8A and 8B, the porous plate member 75 may be formed in a convex shape projecting in the direction in which the wash liquid jet nozzle 73 jets the wash liquid W.

FIGS. 8A and 8B are perspective views illustrating examples of a porous plate member of a bubble generator according to an embodiment of the present disclosure.

For example, a porous plate member 75 may be formed in a truncated quadrangular pyramid shape as illustrated in FIG. 8A. At this time, the bottom surface 75'*a* of the truncated quadrangular pyramid 75' is opened to communicate with the bubble spray part 71, and the front surface 75'*b* and four side surfaces 75'*c* of the truncated quadrangular pyramid 75' may be formed of porous plates provided with a plurality of holes. Therefore, the wash liquid W jetted from the wash liquid jet nozzle 73 passes through the front surface 75'*b* and the side surfaces 75'*c* of the truncated quadrangular pyramid 75' to generate bubbles.

Alternatively, as illustrated in FIG. 8B, the porous plate member 75 may be formed in a substantially semicircular column shape. At this time, in FIG. 8B, the rear surface 75"*a* of the semicircular column shape 75" is opened to communicate with the bubble spray part 71, and the left and right side surfaces 75"*c* are formed to be inclined toward the center. Also, the front surface 75"*b* and the left and fight side surfaces 75"*c* of the semicircular column shape 75" are all formed of porous plates provided with a plurality of holes. Therefore, the wash liquid W jetted from the wash liquid jet nozzle 73 passes through the front surface 75"*b* and the left and right side surfaces 75"*c* of the semicircular column shape 75" to generate bubbles.

The blowing fan 61 is provided at the rear end of the bubble spray part 71, that is, on the opposite side of the porous plate member 75, and blows air A in the direction in which the wash liquid jet nozzle 73 jets the wash liquid W, as illustrated in FIG. 5. In other words, the blowing fan 61 is configured to blow air of a predetermined air volume or more toward the porous plate member 75. Large bubbles are instantaneously generated when the wash liquid W collides against and passes through the porous plate member 75 due to the wind generated by the blowing fan 61. At this time, when the blowing fan 61 applies an air volume larger than the flow amount of the wash liquid W supplied from the wash liquid jet nozzle 73, high expansion bubbles are generated by the wash liquid W which collides against and passes through the porous plate member 75.

In other words, in the bubble generator 70 according to an embodiment of the present disclosure, when the water containing the detergent collides with and passes through the porous plate member 75 having the plurality of holes 75*a*, the blowing fan 61 applies a predetermined air volume to the water, thereby generating high expansion bubbles. As described above, according to the bubble generator 70 of the present disclosure, the bubbles are generated by the plurality of holes 75*a* formed in the porous plate member 75 and the air supplied by the blowing fan 61, so that the volume of the bubbles is highly expanded to 10 times or more compared with the volume of the wash liquid W and a large amount of bubbles are generated quickly.

The high expansion bubbles generated in the porous plate member 75 is supplied to the inside of the tub 20 by the wind supplied by the blowing fan 61 as indicated by arrow B illustrated in FIG. 1. The high expansion bubbles cover the laundry 35 in a wide range and help the wash liquid W to uniformly penetrate the laundry 35, thereby improving the washing performance.

In the present embodiment, the blowing fan 61 uses the blowing fan 61 of the above-described dry apparatus 60. Accordingly, in the present embodiment, as illustrated in FIG. 4, the heater 64 is provided between the bubble spray part 71 and the blowing fan 61.

In the above description, the heater 64 is provided between the bubble spray part 71 and the blowing fan 61. However, a bubble generator 70 according to an embodiment of the present disclosure may not include the heater 64 between the bubble spray part 71 and the blowing fan 61. The bubble generator 70' having such a structure may be applied to a washing machine without the dry apparatus 60 described above.

Hereinafter, a bubble generator in which a bubble spray part and a blowing fan are directly connected with each other will be described with reference to FIGS. 9 and 10.

Figure 9:
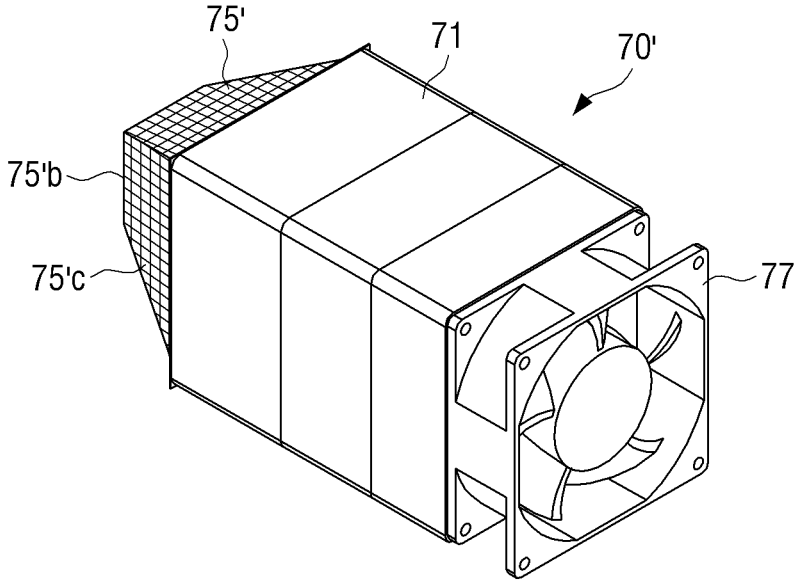
FIG. 9 is a perspective view illustrating a bubble generator according to another embodiment.
Figure 10:
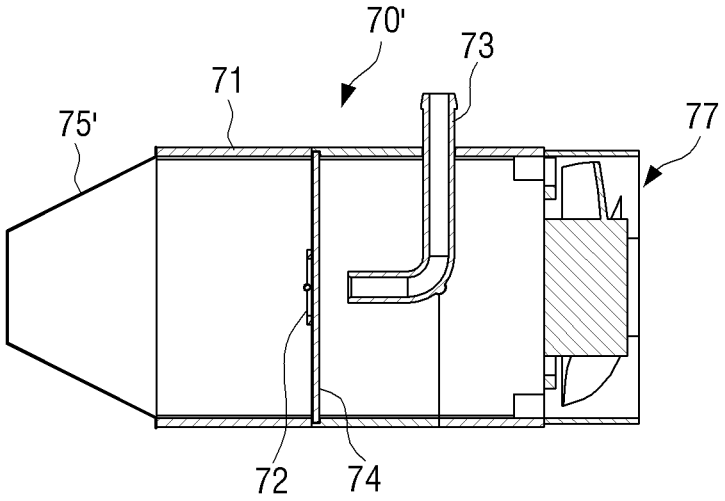
FIG. 10 is a cross-sectional view illustrating the bubble generator of FIG. 9.

FIG. 9 is a perspective view illustrating a bubble generator according to another embodiment of the present disclosure, and FIG. 10 is a cross-sectional view illustrating the bubble generator of FIG. 9.

Referring to FIGS. 9 and 10, a bubble generator 70' according to an embodiment of the present disclosure may include a bubble spray part 71, a wash liquid jet nozzle 73, a porous plate member 75, and a blowing fan 77.

The bubble spray part 71 is disposed on the upper side of the tub 20 and is formed to supply bubbles from the top of the inside of the tub 20 toward the bottom thereof. The bubble spray part 71 may be formed in a duct shape having a substantially rectangular cross-section. The wash liquid jet nozzle 73 may be disposed at the center of the rectangular cross-section of the bubble spray part 71. However, the cross-section of the duct forming the bubble spray part 71 is not limited to a rectangular shape. Depending on the type of the wash liquid jetted from the wash liquid jet nozzle 73, the cross-section of the bubble spray part 71 may be formed in a cross-section having a curved circumference such as a circle, an ellipse, or the like, or a polygonal cross-section such as a triangle, a trapezoid, or the like.

The wash liquid jet nozzle 73 is provided inside the bubble spray part 71 and jets the wash liquid toward the porous plate member 75 provided at the front end of the bubble spray part 71. The wash liquid jet nozzle 73 is connected to a wash liquid supply pipe that can supply the wash liquid.

For example, the wash liquid jet nozzle 73 is connected to the water supply pipe 41 connected to the external water supply source. The water supply pipe 41 may be provided with the detergent suction part 45 configured to suck the liquid detergent as illustrated in FIG. 3. Therefore, when water flows through the water supply pipe 41, the liquid detergent in the detergent supply part 47 is mixed with the water flowing through the water supply pipe 41 by the venturi effect in the detergent suction part 45, and then the water mixed with the detergent is supplied to the wash liquid jet nozzle 73. Therefore, the wash liquid jet nozzle 73 may jet the wash liquid mixed with the detergent.

A wash liquid dispersing member 72 may be provided in front of the wash liquid jet nozzle 73. The wash liquid jetted from the wash liquid jet nozzle 73 collides against the wash liquid dispersing member 72 and is widely dispersed to correspond to the area of the porous plate member 75. The wash liquid dispersing member 72 may be formed in various shapes as long as the wash liquid jetted from the wash liquid jet nozzle 73 can be dispersed to the area corresponding to the porous plate member 75.

In the present embodiment, the wash liquid dispersing member 72 is formed of a porous plate and is fixed to the inner surface of the bubble spray part 71 by a fixing member 74.

The porous plate member 75' is provided at the front end of the bubble spray part 71 and is formed in a substantially truncated quadrangular pyramidal shape. The rear surface of the truncated quadrangular pyramid forming the porous plate member 75' is opened to communicate with the bubble spray part 71, and the front surface 75'*b* and side surfaces 75'*c* of the truncated quadrangular pyramid 75' are formed in porous plates having a plurality of holes. For example, the front surface 75'*b* and side surfaces 75'*c* of the truncated quadrangular pyramid 75' may be formed of a perforated mesh or a screen mesh. Accordingly, when the wash liquid jetted from the wash liquid jet nozzle 73 passes through the front surface 75'*b* and side surfaces 75'*c* of the truncated quadrangular pyramid 75', bubbles are generated.

In the present embodiment, the porous plate member 75' is formed in the truncated quadrangular pyramidal shape. However, the porous plate member 75' may be formed in the semicircular column shape 75" as illustrated in FIG. 8B. Alternatively, although not illustrated, the porous plate member 75' may be formed in various convex shapes protruding in the direction in which the wash liquid jet nozzle 73 jets the wash liquid.

As another example, the porous plate member 75' may be formed in a porous flat plate in which a flat plate is provided with a plurality of holes like the porous plate member 75 of the bubble generator 70 as illustrated in FIGS. 4 and 5.

The wash liquid jetted from the wash liquid jet nozzle 73 collides with the porous plate member 75' and is discharged to the outside of the bubble spray part 71 through the plurality of holes formed in the porous plate member 75', thereby generating bubbles.

The blowing fan 77 is directly connected to the rear end of the bubble spray part 71, that is, the opposite side of the porous plate member 75', and blows air in the direction in which the wash liquid jet nozzle 73 jets the wash liquid. In other words, the blowing fan 77 is provided to blow wind of a predetermined air volume or more toward the porous plate member 75'. Large bubbles are instantaneously generated by the wind generated by the blowing fan 77 when the wash liquid collides with and passes through the porous plate member 75'. At this time, when the blowing fan 77 applies an air volume larger than the flow amount of the wash liquid supplied from the wash liquid jet nozzle 73, high expansion bubbles are rapidly generated by the wash liquid which collides with and passes through the porous plate member 75'.

The blowing fan 77 sucks air inside the main body 10 of the washing machine 1 and blows the air to the bubble spray part 71. However, if necessary, a suction duct (not illustrated) communicating with the outside to suck the outside air may be provided at the rear end of the blowing fan 77, that is, at one end (the suction end) of the blowing fan 77 that is not connected to the bubble spray part 71.

In the bubble generator 70' according to an embodiment of the present disclosure having the above-described structure, when the wash liquid jet nozzle 73 jets the wash liquid and the blowing fan 77 blows air, high expansion bubbles are generated by the wash liquid passing through the porous plate member 75'.

The bubble generator 70' is disposed on the upper side of the tub 20. One end of the bubble spray part 71, that is, the porous plate member 75' may be positioned at the opening 26 provided in the upper portion of the diaphragm 25 connecting the tub 20 and the front frame 11 of the main body 10. Thus, the high expansion bubbles generated in the bubble spray part 71 may be supplied to the laundry 35 located inside the drum 30.

In the above description, the wash liquid jet nozzle 73 is connected to the water supply pipe 41 connected to the external water supply source. However, the wash liquid jet nozzle 73 may be connected to a circulation pipe for circulating water contained in the tub 20, not the external water supply source.

Figure 11:
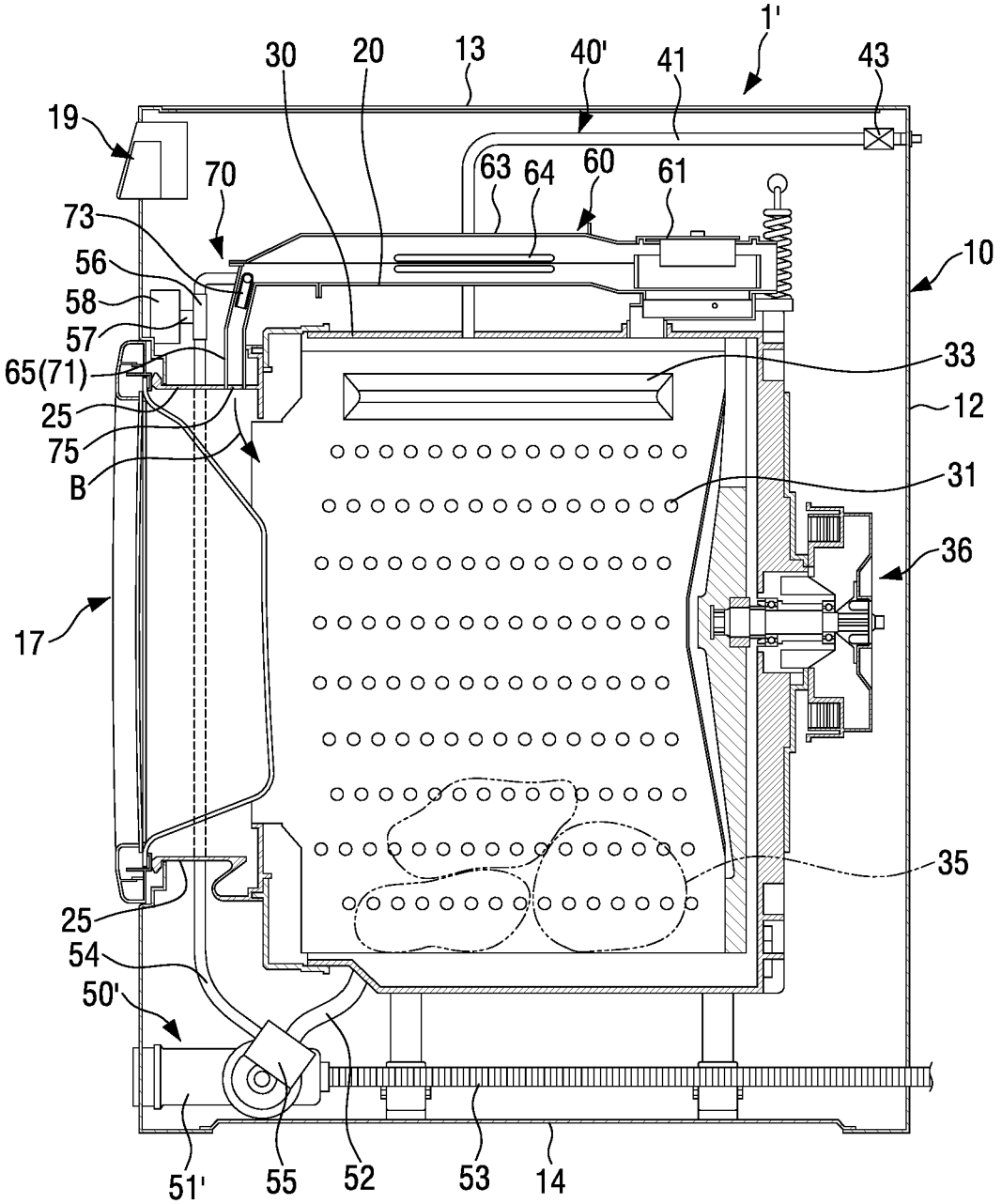
FIG. 11 is a cross-sectional view illustrating a washing machine in which a wash liquid jet nozzle of a bubble generator according to an embodiment is connected to a circulation pipe having a detergent suction part.

FIG. 11 is a cross-sectional view illustrating a washing machine in which a wash liquid jet nozzle of a bubble generator according to an embodiment is connected to a circulation pipe having a detergent suction part.

Referring to FIG. 11, a washing machine 1' according to an embodiment of the present disclosure may include a main body 10, a tub 20, a drum 30, a dry apparatus 60, and a bubble generator 70.

The main body 10, the tub 20, the drum 30, the dry apparatus 60, and the bubble generator 70 of the washing machine 1' according to the present embodiment are the same as or similar to the main body 10, the tub 20, the drum 30, the dry apparatus 60, and the bubble generator 70 of the washing machine 1 according to the above-described embodiment; therefore, detailed descriptions thereof are omitted.

The washing machine 1' according to an embodiment shown in FIG. 11 differs from the washing machine 1 according to the above-described embodiment in the structure for supplying the wash liquid to the wash liquid jet nozzle 73 of the bubble generator 70. Therefore, this difference will be described.

A water supply device 40' is provided to supply water into the tub 20 at the upper side of the tub 20. The water supply device 40' includes a water supply pipe 41 connected to an external water supply source and a water supply valve 43 configured to open and close the water supply pipe 41. One end of the water supply pipe 41 is connected to the upper portion of the tub 20. Therefore, when the water supply valve 43 is opened, water supplied from the external water supply source is supplied to the inside of the tub 20 through the water supply pipe 41.

A water drainage device 50' for draining water from the tub 20 to the outside is provided at the lower side of the tub 20.

The water drainage device 50' may include a circulation pump 51', a first drain pipe 52, a second drain pipe 53, and a circulation pipe 54.

The circulation pump 51' is configured to suck the water in the tub 20. One end of the first drain pipe 52 is connected to the lower portion of the tub 20, and the other end of the first drain pipe 52 is connected to the circulation pump 51' to guide the water in the tub 20 to the circulation pump 51'. One end of the second drain pipe 53 is connected to the circulation pump 51' and the other end of the second drain pipe 53 is extended to the outside of the main body 10 of the washing machine 1', so that the water in the tub 20 is discharged to the outside of the washing machine 1'.

The circulation pipe 54 connects the circulation pump 51' and the wash liquid jet nozzle 73 of the bubble generator 70. In other words, one end of the circulation pipe 54 is connected to the circulation pump 51', and the other end of the circulation pipe 54 is connected to the wash liquid jet nozzle 73. A detergent suction part 56 is provided in the circulation pipe 54.

The detergent suction part 56 is formed as a venturi pipe, and a detergent pipe 57 connected to a detergent supply part 58 is provided at an intermediate portion of the detergent suction part 56. When water is supplied to the circulation pipe 54 by the circulation pump 51', the detergent in the detergent supply part 58 is mixed with and dissolved in the water passing through the circulation pipe 54 by the venturi effect in the detergent suction part 56. Thus, the water mixed with the detergent is supplied to the wash liquid jet nozzle 73 of the bubble generator 70 through the circulation pipe 54.

The circulation pump 51' is provided with a circulation valve 55 configured to change the path of the water drained through the first drain pipe 52 under the control of the controller 100 (see FIG. 2). When the circulation valve 55 is in a first position and the circulation pump 51' is operated, the water drained through the first drain pipe 52 is supplied to the bubble generator 70 through the circulation pipe 54. In other words, the water in the tub 20 is circulated by the circulation pump 51' and the circulation pipe 54. When the circulation valve 55 is in a second position and the circulation pump 51' is operated, the water drained through the first drain pipe 52 is discharged to the outside of the washing machine 1' through the second drain pipe 53.

Therefore, when the detergent is supplied to the laundry 35 using the high expansion bubbles, the controller 100 controls the circulation valve 55 to be in the first position and operates the circulation pump 51'. Thus, the water in the tub 20 is supplied to the wash liquid jet nozzle 73 of the bubble generator 70 through the first drain pipe 52 and the circulation pipe 54. At this time, since the circulation pipe 54 is provided with the detergent suction part 56, when the water passes through the circulation pipe 54, the detergent in the detergent supply part 58 is naturally mixed with the water through the detergent suction part 56 and is supplied to the wash liquid jet nozzle 73.

Since the wash liquid jetted by the wash liquid jet nozzle 73 receives a predetermined amount of air amount applied by the blowing fan 61 while passing through the plurality of holes of the porous plate member 75, the wash liquid becomes high expansion bubbles and then is discharged to the outside of the bubble spray part 71.

In the above description, the detergent is sucked through the detergent suction part 56 and mixed with the water. However, such a structure is effective in the case of the liquid detergent, but in the case of a powder detergent, it is difficult to apply the above-described structure because the powder detergent is not easily dissolved in water.

Hereinafter, a washing machine provided with a bubble generator capable of using a powder detergent will be described with reference to FIG. 12.

Figure 12:
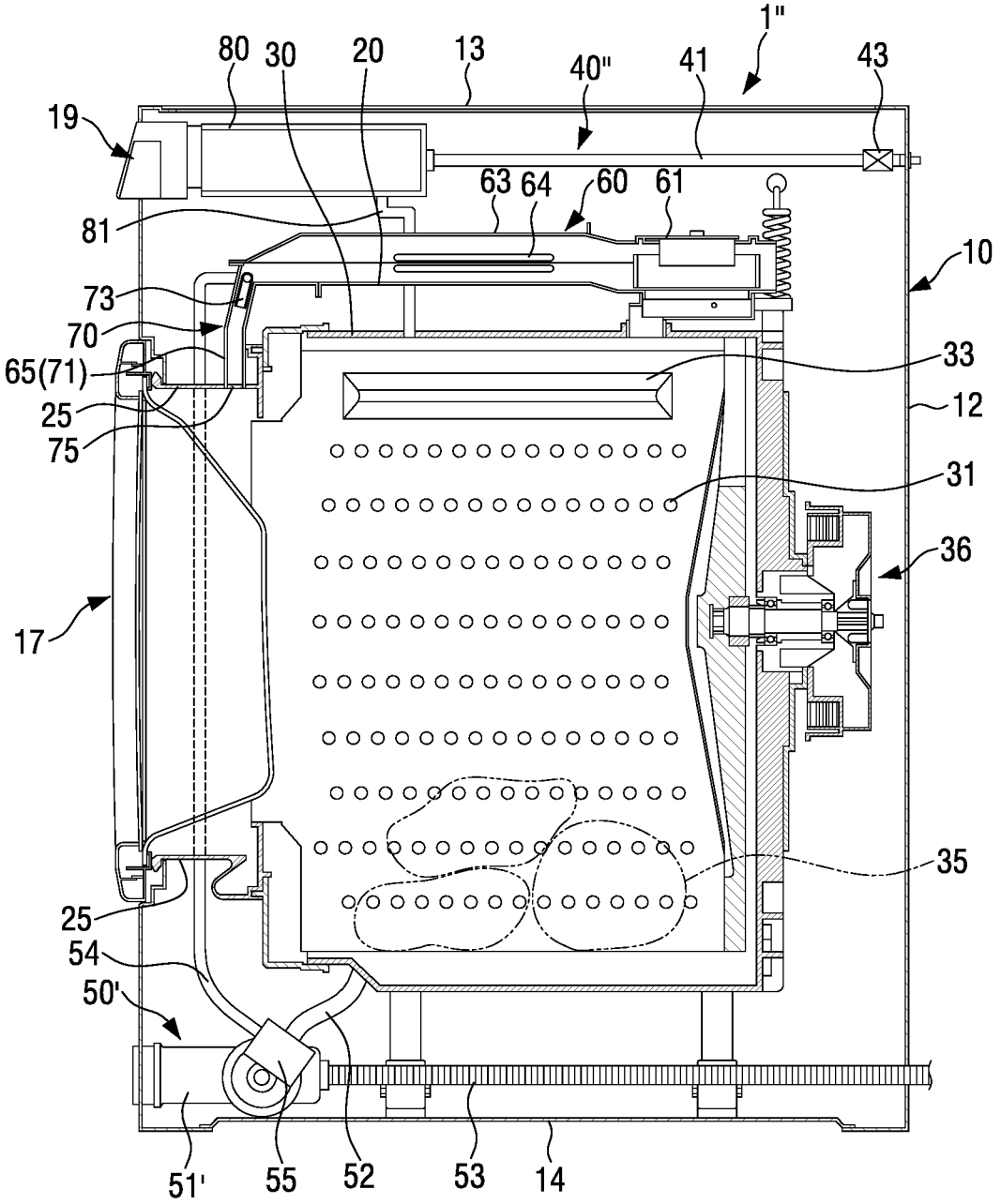
FIG. 12 is a cross-sectional view illustrating a washing machine in which a wash liquid jet nozzle of a bubble generator according to an embodiment is connected to a circulation pipe.

FIG. 12 is a cross-sectional view illustrating a washing machine in which a wash liquid jet nozzle of a bubble generator according to an embodiment is connected to a washing water circulation passage.

Referring to FIG. 12, a washing machine 1" according to an embodiment of the present disclosure may include a main body 10, a tub 20, a drum 30, a dry apparatus 60, and a bubble generator 70.

The main body 10, the tub 20, the drum 30, the dry apparatus 60, and the bubble generator 70 of the washing machine 1" according to the present embodiment are the same as or similar to the main body 10, the tub 20, the drum 30, the dry apparatus 60, and the bubble generator 70 of the washing machine 1 according to the above-described embodiment; therefore, detailed descriptions thereof are omitted.

The washing machine 1'" according to an embodiment shown in FIG. 12 differs from the washing machine 1 according to the above-described embodiment in the structure for supplying the wash liquid to the wash liquid jet nozzle 73 of the bubble generator 70. Therefore, this difference will be described.

A water supply device 40" is provided to supply water into the tub 20 at the upper side of the tub 20. The water supply device 40" includes a water supply pipe 41 connected to an external water supply source and a water supply valve 43 configured to open and close the water supply pipe 41. One end of the water supply pipe 41 is connected to the external water supply source, and the other end of the water supply pipe 41 is connected to a detergent supply device 80.

The detergent supply device 80 is connected to the tub 20 through a connection pipe 81. The water supplied through the water supply pipe 41 is supplied to the inside of the tub 20 through the connection pipe 81 together with the detergent via the detergent supply device 80. The detergent supply device 80 may mix a powder detergent or a liquid detergent with the water and dissolve them in the water.

Therefore, when the water supply valve 43 is opened, the water supplied from the external water supply source is supplied to the detergent supply device 80 through the water supply pipe 41, and the water mixed with the detergent by the detergent supply device 80 is supplied to the inside of the tub 20 through the connection pipe 81.

A water drainage device 50' for draining water from the tub 20 to the outside is provided at the lower side of the tub 20.

The water drainage device 50' may include a circulation pump 51', a first drain pipe 52, a second drain pipe 53, and a circulation pipe 54.

The circulation pump 51' is configured to suck the water in the tub 20. One end of the first drain pipe 52 is connected to the lower portion of the tub 20, and the other end of the first drain pipe 52 is connected to the circulation pump 51' to guide the water in the tub 20 to the circulation pump 51'. One end of the second drain pipe 53 is connected to the circulation pump 51' and the other end of the second drain pipe 53 is extended to the outside of the main body 10 of the washing machine 1" so that the water in the tub 20 is discharged to the outside of the washing machine 1".

The circulation pipe 54 connects the circulation pump 51' and the wash liquid jet nozzle 73 of the bubble generator 70. In other words, one end of the circulation pipe 54 is connected to the circulation pump 51', and the other end of the circulation pipe 54 is connected to the wash liquid jet nozzle 73.

When the water is supplied to the circulation pipe 54 by the circulation pump 51', the water is jetted through the wash liquid jet nozzle 73 of the bubble generator 70. At this time, since the water supplied by the circulation pump 51' is the water mixed with the detergent by the detergent supply device 80, that is, the wash liquid, the wash liquid jet nozzle 73 jets the wash liquid mixed with the detergent.

The circulation pump 51' is provided with a circulation valve 55 configured to change the path of the water drained through the first drain pipe 52 under the control of the controller 100 (see FIG. 2). When the circulation valve 55 is in a first position and the circulation pump 51' is operated, the water drained through the first drain pipe 52 is supplied to the bubble generator 70 through the circulation pipe 54. In other words, the water mixed with the detergent in the tub 20 is circulated to the wash liquid jet nozzle 73 by the circulation pump 51' and the circulation pipe 54. When the circulation valve 55 is in a second position and the circulation pump 51' is operated, the water drained through the first drain pipe 52 is discharged to the outside of the washing machine 1''' through the second drain pipe 53.

Therefore, when the detergent is supplied to the laundry 35 using the high expansion bubbles, the controller 100 controls the circulation valve 55 to be in the first position and operates the circulation pump 51'. Thus, the water in the tub 20 is supplied to the wash liquid jet nozzle 73 of the bubble generator 70 through the first drain pipe 52 and the circulation pipe 54. At this time, since the detergent supplied through the detergent supply device 80 is dissolved in the water in the tub 20, the water containing the detergent in the tub 20 is supplied to the wash liquid jet nozzle 73 by the circulation pump 51' and the circulation pipe 54.

Since the wash liquid jetted by the wash liquid jet nozzle 73 of the bubble generator 70 receives a predetermined amount of air amount applied by the blowing fan 61 while passing through the plurality of holes 75*a* of the porous plate member 75, the wash liquid becomes high expansion bubbles and then is discharged to the outside of the bubble spray part 71.

As described above, since the bubble generator 70 according to an embodiment of the present disclosure instantly generates high expansion bubbles and supplies them to the laundry 35, the wash liquid is uniformly dispersed onto the laundry 35 so that a uniform cleaning effect may be obtained.

In addition, since the bubble generator 70 according to an embodiment of the present disclosure may generate bubbles in a shorter time than the conventional bubble generator, the washing effect may be improved.

Further, in the washing machine provided with the bubble generator 70 according to an embodiment of the present disclosure, the bubble generator 70 is provided at the upper side of the tub 20 so that bubbles are sprayed downward from the upper portion of the drum 30. Therefore, the user may visually check whether bubbles are generated or not.

In the above description, the bubble generator according to an embodiment of the present disclosure is applied to the drum washing machine. However, the bubble generator according to an embodiment of the present disclosure may be applied to a pulsator washing machine.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a tub; and a bubble generator comprising:

a bubble spray duct provided at an upper side of the tub and configured to discharge bubbles from a top to a bottom inside the tub;

a wash liquid jet nozzle provided inside the bubble spray duct and configured to jet wash liquid;

a blowing fan provided on the bubble spray duct upstream from the wash liquid jet nozzle and configured to blow air in a direction in which the wash liquid jet nozzle jets the wash liquid in a manner that the air is blown around the wash liquid jet nozzle; and a porous plate member provided at a front end of the bubble spray duct and including a plurality of holes, wherein when the wash liquid jetted from the wash liquid jet nozzle collides with the porous plate member, bubbles are generated.

2. The washing machine of claim 1, further comprising:

a wash liquid disperser provided in front of the wash liquid jet nozzle in a manner to disperse the wash liquid jetted from the wash liquid jet nozzle.

3. The washing machine of claim 2, wherein a surface of the wash liquid disperser facing the wash liquid jet nozzle is formed in a spherical shape.

4. The washing machine of claim 2, wherein the wash liquid disperser comprises a porous plate.

5. The washing machine of claim 1, wherein the porous plate member comprises a perforated mesh or screen mesh.

6. The washing machine of claim 5, wherein the porous plate member is formed in a convex shape protruding in a direction in which the wash liquid jet nozzle jets the wash liquid.

7. The washing machine of claim 1, wherein:

the bubble spray duct includes a rectangular cross-section, and the wash liquid jet nozzle is disposed at a center of the rectangular cross-section.

8. The washing machine of claim 1, wherein:

the wash liquid jet nozzle is connected to a water supply pipe connected to an external water supply source, and the water supply pipe is provided with a detergent suction part configured to suck detergent.

9. The washing machine of claim 8, wherein the detergent suction part comprises a venturi pipe.

10. The washing machine of claim 1, wherein:

the wash liquid jet nozzle is connected to a circulation pipe connected to a circulation pump and configured to circulate water received in the tub, and the circulation pipe is provided with a detergent suction part configured to suck detergent.

11. The washing machine of claim 10, wherein the detergent suction part comprises a venturi pipe.

12. The washing machine of claim 1, wherein the wash liquid jet nozzle is connected to a circulation pipe connected to a circulation pump and configured to circulate water received in the tub.

13. The washing machine of claim 1, wherein a dry duct provided with a heater is disposed between the bubble spray duct and the blowing fan.

* * * * *